US006564936B1

(12) United States Patent
Campbell

(10) Patent No.: US 6,564,936 B1
(45) Date of Patent: May 20, 2003

(54) GOLF BAG WITH CLUB SEPARATOR

(75) Inventor: Derek Campbell, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 09/892,294

(22) Filed: Jun. 26, 2001

(51) Int. Cl.[7] ..... A63B 55/00
(52) U.S. Cl. ..... 206/315.6; 206/315.3
(58) Field of Search ..... 206/315.3, 315.5, 206/315.6

(56) References Cited

U.S. PATENT DOCUMENTS

| | | | | | |
|---|---|---|---|---|---|
| 2,705,518 | A | * | 4/1955 | Burton, Jr. | 206/315.6 |
| 3,331,419 | A | * | 7/1967 | Bencriscutto | 206/315.6 |
| 3,503,518 | A | * | 3/1970 | Black | 206/315.6 X |
| 4,208,227 | A | * | 6/1980 | Cowam | 206/215.6 X |
| 4,881,638 | A | | 11/1989 | Cho | |
| 5,038,984 | A | | 8/1991 | Izzo | |
| 5,042,703 | A | | 8/1991 | Izzo | |
| 5,042,704 | A | | 8/1991 | Izzo | |
| 5,103,974 | A | | 4/1992 | Antonious | |
| 5,228,566 | A | | 7/1993 | Shenoha | |
| 5,332,090 | A | | 7/1994 | Tucker | |
| 5,450,955 | A | * | 9/1995 | Olson | 206/315.6 |
| 5,458,240 | A | | 10/1995 | Rich et al. | |
| 5,501,328 | A | | 3/1996 | Keller et al. | |
| 5,624,028 | A | | 4/1997 | Shin et al. | |
| D385,113 | S | | 10/1997 | Beck et al. | |
| 5,725,095 | A | | 3/1998 | Beck et al. | |
| 5,755,322 | A | * | 5/1998 | Yang | 206/315.6 X |
| 5,785,173 | A | * | 7/1998 | Kim | 206/315.6 |
| 5,816,397 | A | | 10/1998 | Pratt | |
| 5,860,520 | A | | 1/1999 | Tang | |
| 5,868,247 | A | * | 2/1999 | Schrader | 206/315.6 X |
| 5,871,093 | A | * | 2/1999 | Sutter | 206/315.6 |
| 5,944,184 | A | | 8/1999 | Smith | |
| 6,109,433 | A | | 8/2000 | Pratt | |
| 6,149,000 | A | * | 11/2000 | Kim | 206/315.6 |
| 6,158,581 | A | * | 12/2000 | Hong | 206/315.3 |
| 6,161,691 | A | | 12/2000 | Ratcliff et al. | |
| 6,269,947 | B1 | * | 8/2001 | Chang | 206/315.6 |

FOREIGN PATENT DOCUMENTS

| | | |
|---|---|---|
| GB | 2 266 670 | 11/1993 |

OTHER PUBLICATIONS

OGIO Sport 2000 Catalog, published 1999.
NIKE Golf Specialty Footwear & Equipment Catalog, published Jun. 1, 2000.

* cited by examiner

*Primary Examiner*—Sue A. Weaver
(74) *Attorney, Agent, or Firm*—Banner & Witcoff, Ltd.

(57) ABSTRACT

The invention is a golf bag for receiving and transporting golf clubs and other golf-related equipment, wherein a top section of the golf bag is configured to organize frequently-used golf clubs and protect golf club heads and shafts that are prone to damage. Organization and protection are achieved through centrally-located areas that permit clubs to be retrieved and replaced without interference by other clubs and structures that prevent the head or shaft of a golf club from making contact with other golf clubs.

26 Claims, 4 Drawing Sheets

GOLF BAG WITH CLUB SEPARATOR

BACKGROUND OF THE INVENTION

1. Field of the Invention

The invention relates to an implement for use in the game of golf, more particularly to a golf bag for receiving golf clubs, wherein areas within the bag organize frequently-used golf clubs and protect golf clubs from damage.

2. Description of Background Art

The game of golf is played using a specialized set of equipment, including golf clubs. A set of golf clubs may contain fourteen or more clubs, including irons, woods, and a putter. In general, a golf club is formed of a shaft and a head attached to one end of the shaft. To provide a padded and secure area for gripping the club, a grip surrounds the shaft opposite the head. This configuration makes carrying numerous clubs cumbersome without use of a golf bag. The typical golf bag is cylindrical and has an open top through which golf clubs are inserted and removed. When positioned in the golf bag, the grips of the golf clubs rest on the bottom surface of the bag with the club heads extending from the open top. Modern golf bags often contain dividers near the open top that serve to separate the golf clubs.

The primary purposes of a golf bag are to organize and protect golf clubs during transport. When transporting a golf bag containing numerous clubs, the clubs often shift positions, making it difficult to identify a specific club and extract the club once identified. Furthermore, shifting may create an uneven weight distribution that makes carrying the bag difficult. As such, a convenient system of organization ensuring that clubs remain in their assigned areas is necessary to a well-designed golf bag.

With regard to protection, advances in materials engineering have improved club performance at the cost of durability, particularly with woods and putters. Graphite shafts that are frequently used in modern golf clubs, particularly with woods such as the driving club, are easily scratched or nicked when contact is made with the metal shafts or heads of other clubs. Similarly, the enlarged heads and ball-engaging face of modern putters are prone to damage when contacting other clubs. For these reasons, golf bags must impart protection to golf clubs by preventing unnecessary contact between individual clubs.

Numerous golf bag designs attempt to create a convenient system for organizing and protecting golf clubs during transport. U.S. Pat. No. 5,944,184 to Smith discloses a system of protection and organization wherein the irons are inserted into pre-assigned areas such that the heads contact the bottom surface of the golf bag. Other areas are assigned to the woods and the putter wherein the heads extend from the top of the bag. U.S. Pat. No. 5,816,397 to Pratt discloses a partition attached to the open top of a golf bag that includes grooves extending upward to retain and segregate the clubs. U.S. Pat. No. 5,624,028 to Shin et al. discloses a receptacle attached to the open top of a golf bag that includes a plurality of compartments for receiving clubs. U.S. Pat. No. 5,458,240 to Rich et al. discloses a golf bag with a top portion having shallow indentations for receiving club heads. On the interior of each indentation is an opening through which the shaft may be inserted. Extending downward from each shaft opening is a protective sleeve for preventing contact between individual shafts.

The prior art golf bags discussed above serve to organize and protect golf clubs but fail to consider practicalities associated with organization and protection. The putter is the shortest club. Because of the putter's length, it is usually shorter than the golf bag itself, making retrieval of the putter difficult when it is placed among other clubs. The short length also permits the putter head to contact the edge of the golf bag, thereby causing undue wear, and become entangled with the shafts of other clubs, making removal difficult. With regard to use, the putter is statistically the most frequently used club, followed by the driving club. As such, a well-designed system of organization should place the putter and driving club in a prominent and easily accessible area.

U.S. Pat. No. 6,161,691 to Ratcliff et al. discloses a mount for securing a putter in a golf bag. The mount includes a bracket attached to the edge of the bag that receives the putter head. Similarly, U.S. Pat. No. 5,332,090 to Tucker discloses a clip-mounted device that mounts the putter to the exterior of the golf bag. U.S. Pat. No. 5,860,520 to Tang and U.S. Pat. No. 5,725,095 to Beck et al. disclose golf bags having a plurality of compartments for housing the irons, wedges, and woods, and segregated compartments for the putter. Finally, U.S. Pat. No. 4,881,638 to Chow discloses a putter housing on the exterior of a golf bag.

Based on the prior art, a need exists for a golf bag that organizes all clubs, while giving prominence and a high degree of protection to the head of a putter and the graphite shaft of a driving club. The following, disclosed invention relates to such a golf bag.

BRIEF SUMMARY OF THE INVENTION

The present invention relates to a golf bag for receiving and transporting golf clubs including woods, irons, and a putter. The golf bag is comprised of a substantially hollow, elongate body, a base element, and an upper element. The body has a front portion, a pair of side portions, a back portion, an open upper end, and a lower end which is covered by the base element. The upper element attaches to the upper end of the body and includes a U-shaped protective divider and at least one general divider. The U-shaped protective divider has a pair of spaced leg segments and a base segment, each leg segment having a terminal end and an opposite end which is connected to said base segment. The leg segments extend inward from the upper end of the front portion of the body to define at least one protective aperture which may be located adjacent to the front portion of the body. The at least one general divider extends from the U-shaped protective divider to one of the pair of side portions or the back portion to thereby form a plurality of general apertures that are segregated from the first protective aperture by the U-shaped protective divider. A partition may extend downward from each of the protective dividers to the base element, thereby dividing the interior of the body into compartments.

The at least one protective aperture may include a first protective aperture that is positioned adjacent to the body, preferably in the front of the golf bag. The first protective aperture may receive a golf club, preferably a putter. The grip end of the putter may rest on the base element with the putter head positioned between the leg segments of the U-shaped protective divider. In this position, the user of the golf bag may insert the putter into the first protective aperture and remove the putter from the first protective aperture without interference from other golf clubs held by the golf bag in sections defined by the general apertures.

The at least one protective aperture may further include a second protective aperture. The second protective aperture may be formed in the protective divider and may be located adjacent to the first protective aperture. The second protective aperture may receive a golf club, such as the driving club, and, in conjunction with the partition, serves the purpose of protecting the shaft of the driving club from damage by segregating the shaft from other clubs. Like the head of the putter, a graphite shaft of a driving club is prone to damage when contacted by other clubs. In addition to protecting the shaft, the second protective aperture makes the driving club accessible to the user of the golf bag. Although not used on every hole, the driving club is statistically the second most frequently used golf club. As such, placement of the driving club in the center of the golf bag has the advantage of improved access.

The first and second protective apertures, in conjunction with the general apertures, form a system wherein the most frequently used and most easily damaged golf clubs are most accessible to the user and adequately protected from making contact with other clubs.

Various advantages and features of novelty which characterize the invention are pointed out with particularity in the claims. However, for a better understanding of the invention, its advantages, and objects obtained by its use, reference should be made to the drawings, and to the accompanying descriptive matter, in which there is illustrated and described preferred embodiments of the invention.

DETAILED DESCRIPTION OF THE INVENTION

Figure 1:
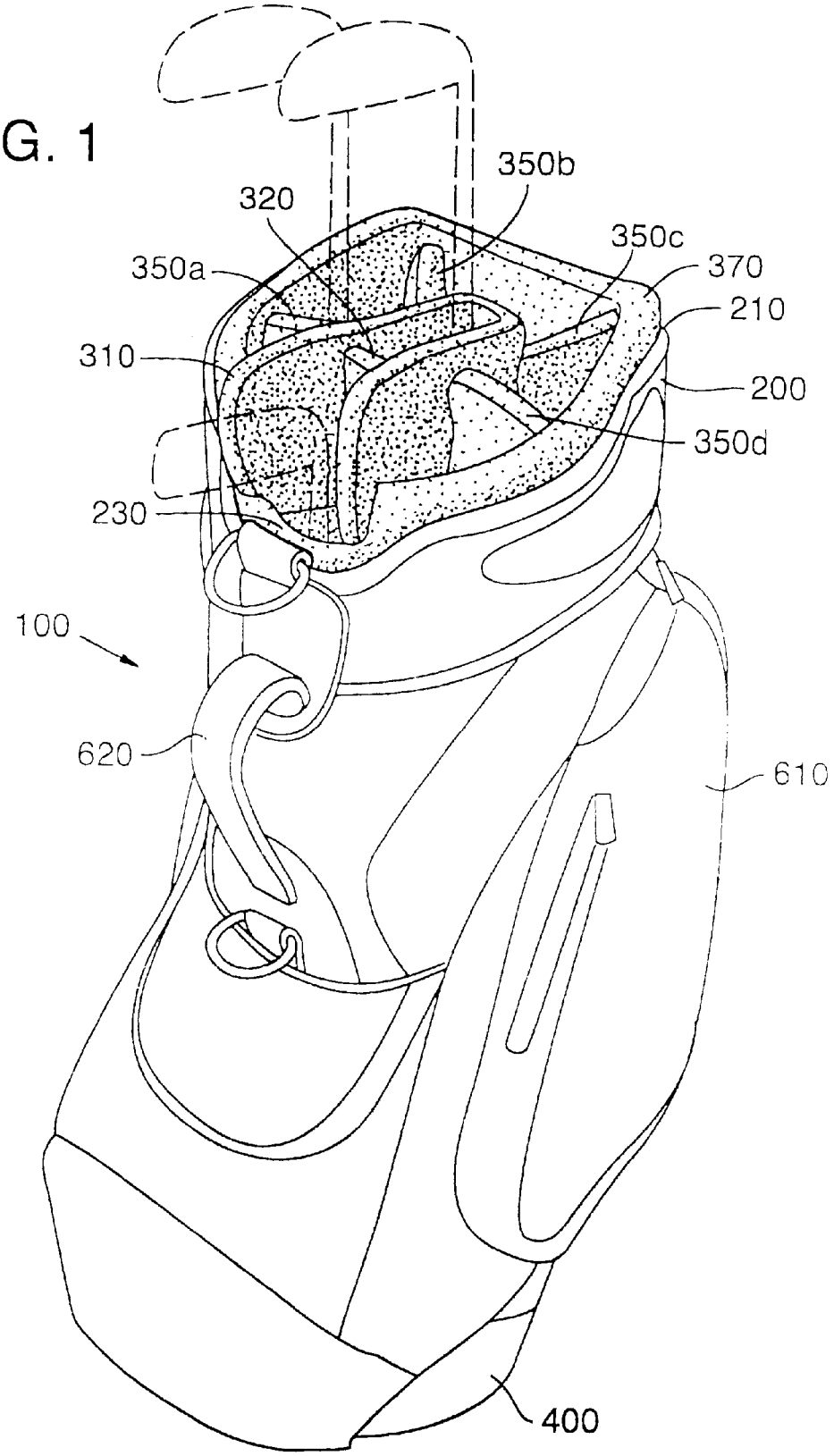
FIG. 1 is a perspective view depicting a preferred embodiment of the golf bag of the present invention.

Referring to the figures, wherein like numerals indicate like elements, a golf bag in accordance with the present invention is illustrated. Golf bag 100 is primarily comprised of an elongate body 200, an upper element 300, a base element 400, and a partition 500. Body 200 is substantially hollow and tubular and formed of a front portion 202, two side portions 204*a*–204*b*, a back portion 206, an upper end 210, and a lower end 220. Attached to body 200 in the region of upper end 210 is an upper element 300. A base element 400 is attached to body 200 in the region of lower end 220 and is preferably comprised of a rigid and durable polymer. A partition 500 is longitudinally positioned within the interior of body 200 and may be joined to upper element 300 and base element 400.

Figure 3:
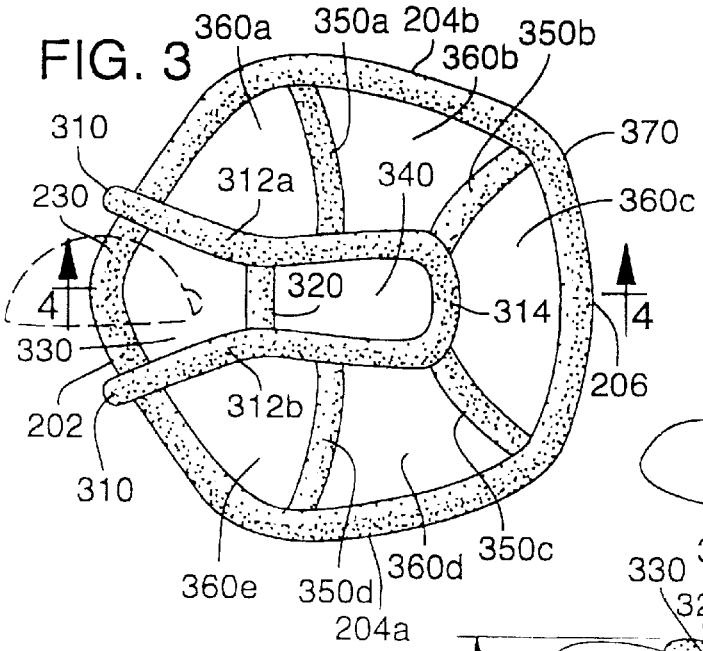
FIG. 3 is a top view depicting the upper element of the golf bag of FIG. 1.

Upper element 300 forms the basis for a system wherein the most frequently used golf clubs are both accessible to the user and adequately protected from making contact with other clubs. Referring to FIG. 3, the configuration of upper element 300 is illustrated. Upper element 300 includes a plurality of dividers that define apertures through which golf club shafts pass when being received in golf bag 100. The primary divider is a protective divider 310, having leg segments 312*a*–312*b* and a base segment 314. Protective divider 310 encompasses a first protective aperture 330, for receiving a club, such as the putter, and a second protective aperture 340, for receiving another club, such as the driving club. Preferably, first protective aperture 330 and second protective aperture 340 are aligned along a centerline that connects front portion 202 with back portion 206. Further, second protective aperture 340 maybe centrally located within upper end 210. A dividing wall 320 separates first protective aperture 330 from second protective aperture 340. Four general dividers 350*a*–350*d* extend from protective divider 310 to a rim section 370 to form general apertures 360*a*–360*e*.

The basis for upper element 300 is a core which may be formed from a single element of a rigid or semi-rigid thermoplastic material having a U-shaped central portion for forming protective divider 310, four extensions for forming general dividers 350*a*–350*d*, and an outer portion for forming rim section 370. Rim section 370 has semi-straight sides with rounded junctions between the sides, thereby forming a shape that generally corresponds with the shape of upper end 210 Preferably, a cushion or pad, having foam within a textile layer for example, surrounds the core that forms protective divider 310, general dividers 350*a*–350*d*, and rim section 370. The foam and textile provide a cushioned surface for contacting and providing protection to the golf clubs.

Modern putters often include ball-engaging faces that are prone to damage when contact is made with other objects, such as golf clubs. In addition, the putter is statistically the most frequently used of all golf clubs. To provide a protective and easily accessible area for receiving the putter, upper element 300 includes first protective aperture 330, which is bounded by leg segments 312*a* and 312*b*, dividing wall 320, and a portion of body 200 preferably comprised of an indentation 230. Leg segments 312*a*–312*b* preferably angle outwardly in the direction of body 200 so that the terminal ends of protective divider 310 that may protrude outside of body 200 are spaced further from one another than interior portions of protective divider 310, thereby accommodating larger-sized putter heads.

When the putter is received in first protective aperture 330, the shaft extends through the interior of body 200 and the grip contacts upper surface 410 of base element 400. The putter head is then situated between leg segments 312*a*–312*b*. Putter heads come in various shapes and sizes. Depending upon the head size and configuration, the putter head may be positioned with the head pointing interiorly towards the bag center (not shown in the figures) or, as shown in the figures, the putter head may be positioned in an opposite direction and pointing outward. In either scenario, a portion of the putter head, again depending upon its shape and size, may extend over indentation 230. The ball-engaging face of the putter may contact the protective surface of either leg segment 312*a* or leg segment 312*b*, depending upon whether the putter was designed for right-handed or left-handed use, respectively. To provide sufficient protection of the putter face, leg segments 312*a*–312*b* preferably pass over indentation 230 and extend approximately three-fourths inch beyond body 200.

Standard putter lengths range between 32 and 35 inches. To ensure that the putter grip contacts upper surface 410, indentation 230 is preferably formed at a height of approximately 32 inches relative to upper surface 410. Similarly, to ensure that the face of a putter having a length of 35 inches is adequately protected, protective divider 310 preferably extends upward to a height of approximately 36.5 inches relative to upper surface 410.

The second most frequently used golf club is the driving club. Modem driving clubs frequently utilize a graphite shaft that may become damaged upon contact with another golf club. A second portion of the organizational and protective system embodied in the present invention involves a separate, easily accessible, protective area which may receive the driving club, such area being second protective aperture 340. Second protective aperture 340 is located adjacent to first protective aperture 330 and bounded by aft portions of leg segments 312*a*–312*b*, base segment 314, and dividing wall 320. Centrally located relative to upper end 210, second protective aperture 340 may receive the shaft of the driving club and, in conjunction with partition 500, serves to protect the shaft by segregating the shaft from the shafts of other clubs. When the driving club is received in second protective aperture 340, the club is centrally located with the head of the driving club exposed. This permits the user to easily remove the driving club from protective aperture 340 without significant interference from other clubs. The tern "driving club" is used herein to refer to any of the various clubs that the golfer may select to "tee off" or commence with. It may be a wood or driver such as a number 1, 3, or 5 driver for example. But it should be understood that second protective aperture 340 may be used to receive any of the various clubs that the golfer may possess, preferably clubs having longer shafts or graphite shafts.

Figure 4:
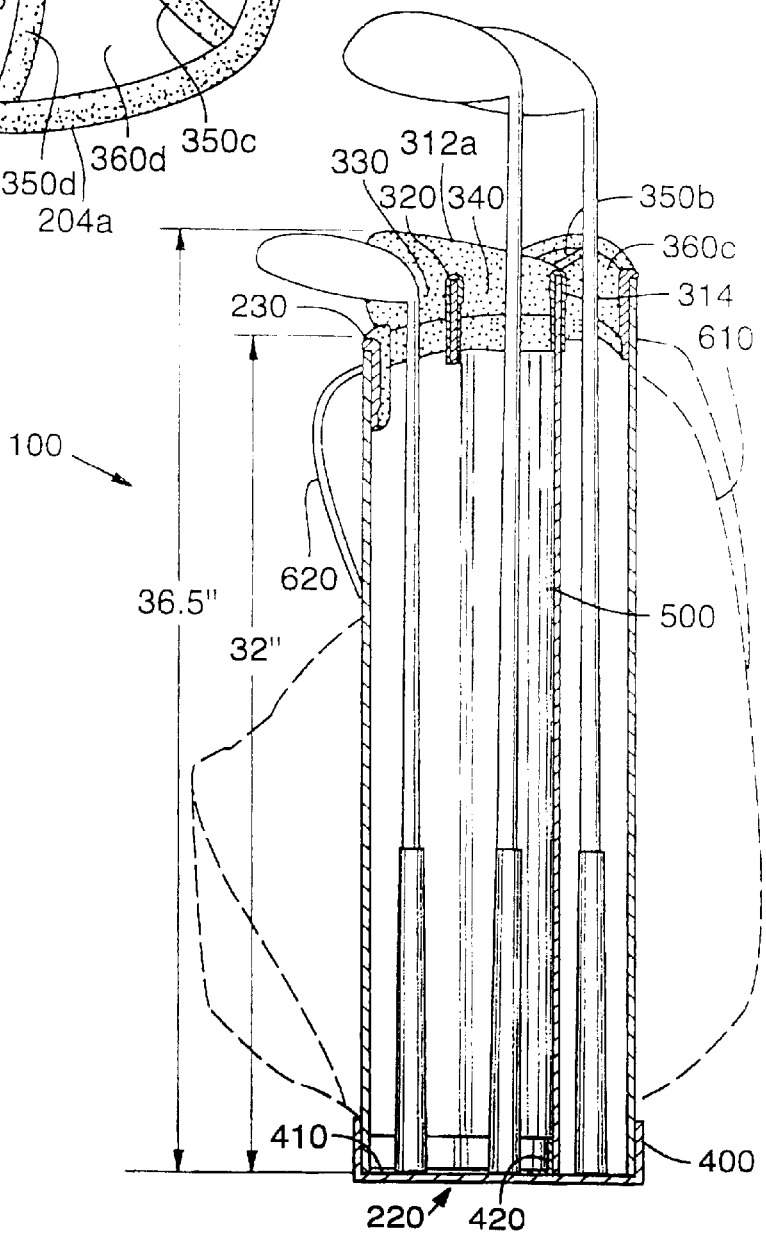
FIG. 4 is a cross-sectional view of the preferred embodiment of the present invention generally along line 4—4 of FIG. 3.
Figure 5:
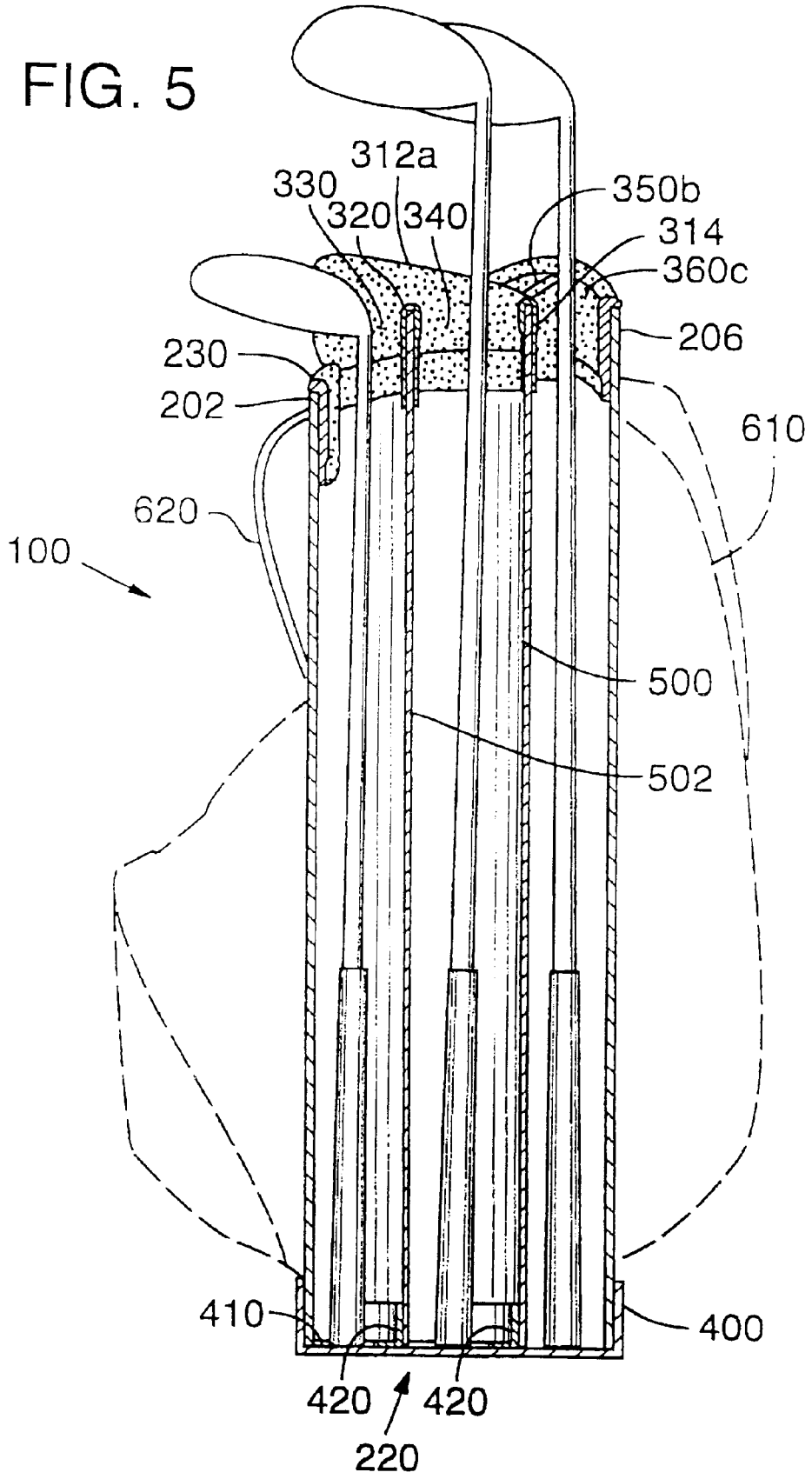
FIG. 5 is a cross-sectional view of an alternate embodiment of the present invention.

Referring to FIG. 4, partition 500, which maybe formed of a durable textile, extends downward from protective divider 310 and connects with base element 400. Partition 500 serves to divide the interior of body 200 into compartments. The first compartment extends downward from first protective aperture 330 and second protective aperture 340 and receives the shafts of the putter and driving club. The second compartment extends downward from general apertures 360*a*–360*e* and receives the shafts of the other golf clubs. In the preferred embodiment, partition 500 is secured to upper surface 410 of base element 400 by stitching the vertical leg of an L-shaped plastic member 420 to the lower end of partition 500 and riveting the horizontal leg directly to base clement 400. In alternate embodiments, the two compartments maybe further subdivided by separate partitions. For example, partition 502 may extend downward from dividing wall 320, as illustrated in FIG. 5, such that the shafts of the putter and driving club are segregated. Partitions may also extend downward from one or more general dividers 350*a*–350*d* so as to prevent shafts and grips of the golf clubs received in general apertures 360*a*–360*e* from becoming entangled.

Protective apertures 330 and 340 serve to organize the putter and driving club. The remaining clubs, which may include the irons and woods, are distributed among five general apertures 360*a*–360*e*. Extending from body 200 in the area of upper end 210 and connecting with protective divider 310 are five general dividers 350*a*–350*d*. The spaces bounded by general dividers 350*a*–350*d*, protective divider 310, and rim section 370 define general apertures 360*a*–360*e*.

Figure 2:
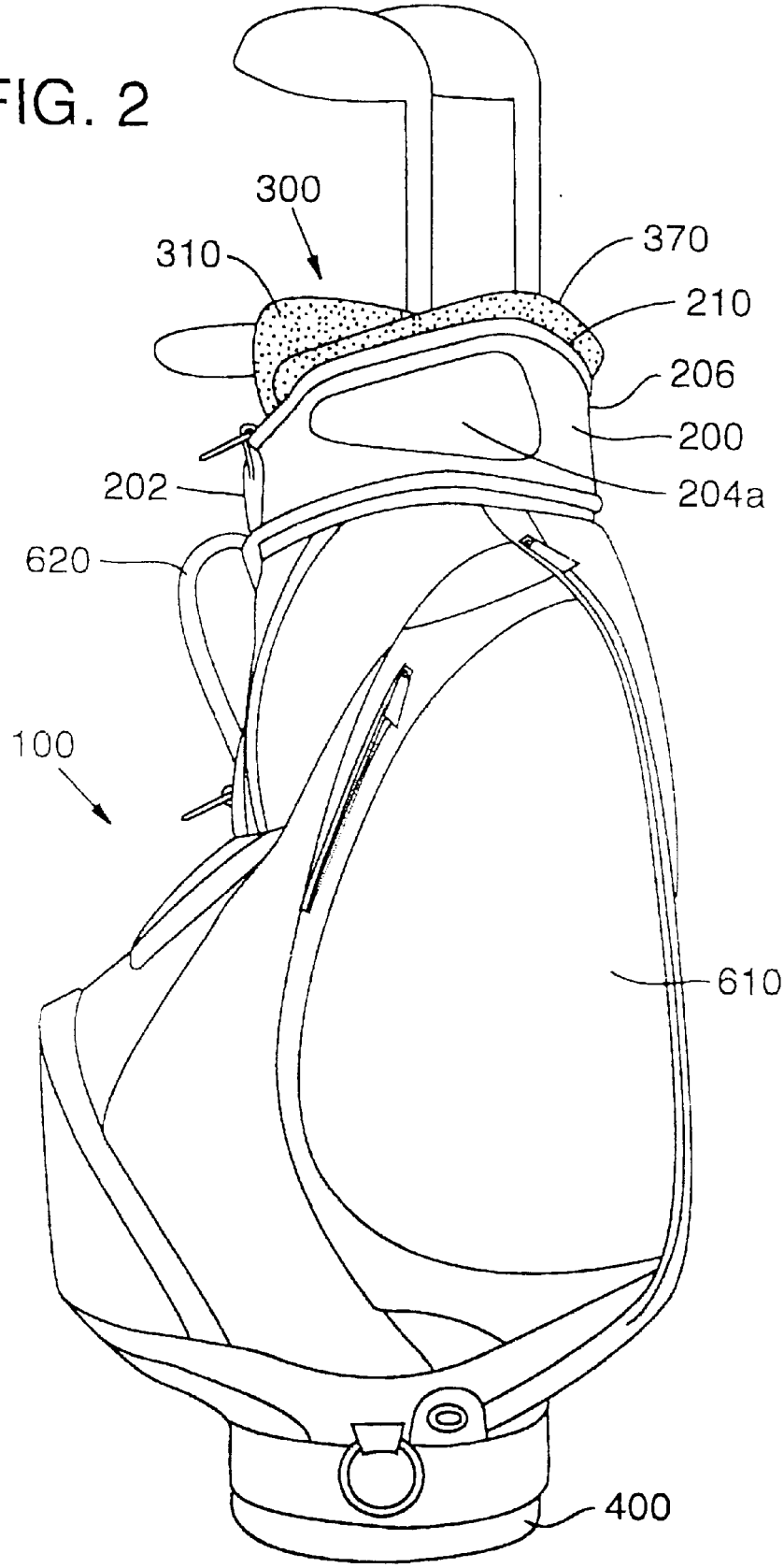
FIG. 2 is a side elevational view of the golf bag of FIG. 1.

As depicted in FIGS. 1 and 2, rim section 370 preferably includes a general downward cant directed toward indentation 230. The downward cant adds to the organizational system of the present invention by providing general apertures 360*a*–360*e* with varying heights. General aperture 360*c*, preferably having the greatest height, may receive golf clubs with greater lengths, such as the woods. To facilitate removal of these golf clubs, the upper edge of body 200 may include a concave section adjacent to general aperture 360*c*. In the preferred embodiment, general apertures 360*a* and 360*e*, being shorter than general apertures 360*b*–360*d*, may receive golf clubs with shorter heights, such as the wedges and higher-numbered irons. The remaining clubs may be distributed among general apertures 360*b* and 360*d*.

In addition to the general downward cant of rim section 370 that is directed toward indentation 230, a top edge of leg segments 312*a* and 312*b* may slope downward in a reverse direction and toward a back portion of golf bag 100, as depicted in FIGS. 2, 4, and 5, for example. That is, the top edge of leg segments 312*a* and 312*b* may slope upward in the direction toward indentation 230, which is located on a front portion of golf bag 100.

Additional elements of golf bag 100 may include pockets 610 and handle 620. Pockets 610 may be attached in a conventional manner to exterior portions of golf bag 100 and store golf equipment other than golf clubs, including towels, golf balls, and tees. A zipper or hook and loop closure device secures items contained within pockets 610. Handle 620 is used to lift golf bag 100. In addition, one or more carrying straps that permits the user to support the weight of golf bag 100 on a shoulder or shoulders may be attached to the exterior in either the front of back.

This invention has been disclosed with reference to the preferred embodiments. These embodiments, however, are merely for example only and the invention is not restricted thereto. It will be understood by those skilled in the art that other variations and modifications can easily be made within the scope of this invention, as defined by the appended claims.

That which is claimed is:

1. A golf bag for receiving and transporting golf clubs including woods, irons, and a putter, said golf bag comprising:

(a) a substantially hollow, elongate body having a front portion, a pair of side portions, a back portion, an open upper end, and a lower end;

(b) a base element covering said lower end of said body; and (c) an upper element attached to said upper end of said body, said upper element including:

(i) a generally U-shaped protective divider having a pair of spaced leg segments and a base segment, each said leg segment having a terminal end and an opposite end which is connected to said base segment, said leg segments extending inward from said upper end of said body to said base segment, thereby defining at least a first protective aperture, said first protective aperture being located adjacent to said body, and (ii) at least one general divider extending from said U-shaped protective divider to one of said pair of side portions or said back portion to thereby form a plurality of general apertures, said general apertures being segregated from said first protective aperture by said U-shaped protective divider, wherein said upper end of said body includes an indentation located between said leg segments, said indentation having an edge with a height lower than other portions of said upper end.

2. The golf bag of claim 1, wherein said first protective aperture is centrally located adjacent to said front portion such that a user of said golf bag may insert the putter into said first protective aperture and remove the putter from said first protective aperture without interference by other golf clubs received in said general apertures.

3. The golf bag of claim 1, wherein said terminal ends of said leg segments of said U-shaped protective divider extend beyond an exterior of said body such that portions of a head of the putter extending beyond the exterior of said body are protected by said U-shaped protective divider.

4. The golf bag of claim 1, wherein said leg segments of said U-shaped protective divider extend into a central portion of said upper end, and a dividing wall extends between said leg segments at a location spaced from said base segment of said U-shaped protective divider, thereby defining a second protective aperture for receiving a second golf club.

5. The golf bag of claim 4, wherein a partition extends from said leg segments and said base segment of said U-shaped protective divider to said base element, thereby defining compartments within said body.

6. The golf bag of claim 1, wherein said leg segments extend above said indentation to protect the head of the putter.

7. The golf bag of claim 1, wherein the height of said indentation is such that the head of the putter is located above said indentation when a grip of the putter contacts said upper surface of said base element.

8. The golf bag of claim 1, wherein the height of said edge of said indentation relative to said upper surface of said base element is approximately 32 inches and the height of an upper edge of said U-shaped protective divider in the region of said first protective aperture relative to said upper surface of said base element is approximately 36.5 inches.

9. The golf bag of claim 1, wherein said leg segments of said U-shaped protective divider angle outwardly such that said terminal ends of said leg segments are spaced further from one another than said opposite ends to thereby accommodate larger-sized putter heads.

10. A golf bag for receiving and transporting golf clubs including woods, irons, and a putter, said golf bag comprising:

(a) a substantially hollow, elongate body having a front portion, a pair of side portions, a back portion, an open upper end, and a lower end;

(b) a base element covering said lower end of said body; and (c) an upper element attached to said upper end of said body, said upper element including a protective divider and a plurality of general dividers, said protective divider segregating a first protective aperture, for receiving the putter, and a second protective aperture, for receiving a second club, from a plurality of general apertures, said general apertures being formed by said general dividers:

(i) said protective divider having a pair of spaced leg segments connected by a base segment, each said leg segment having a terminal end which extends beyond the exterior of said body and an opposite end which is connected to said base segment; said upper end of said body having an indentation located between said leg segments, said indentation having a height lower than other portions of said upper end to allow a head of a putter received in said first protective aperture to extend over said indentation; said leg segments having a height extending above said indentation to protect the head of the putter from contact with clubs received in said general apertures; and said leg segments angling outwardly such that said terminal ends are spaced further from one another than said opposite ends, thereby accommodating oversized putter heads, (ii) said first protective aperture being located adjacent to said front portion such that a user of said golf bag may insert the putter into said first protective aperture and remove the putter from said first protective aperture without interference by clubs received in said general apertures, and (iii) said second protective aperture being defined by said leg segments, said base segment, and a dividing wall that extends between said leg segments at a location spaced from said base segment.

11. The golf bag of claim 10, wherein a partition extends from said leg segments and said base segments of said protective divider to said base element.

12. The golf bag of claim 11, wherein said protective divider and said partition cooperatively protect a shaft of the second golf club received in said second protective aperture by preventing contact between the shaft of the second golf club and shafts of other golf clubs received in said general apertures.

13. The golf bag of claim 10, wherein the height of said indentation is such that the head of the putter is located above said indentation when a grip of the putter contacts an upper surface of said base element.

14. The golf bag of claim 10, wherein the height of said lower edge of said indentation relative to said upper surface of said base element is approximately 32 inches and the height of an upper edge of said protective divider in the region of said first protective aperture relative to said upper surface of said base element is approximately 36.5 inches.

15. The golf bag of claim 10, wherein a second partition extends from said dividing wall to said base element, said dividing wall and said second partition cooperatively preventing contact between a shaft of the putter and a shaft of the second club.

16. The golf bag of claim 10, wherein portions of said leg segments adjacent to said second protective aperture are substantially parallel.

17. A golf bag for receiving and transporting golf clubs including woods, irons, and a putter, said golf bag comprising:

(a) a substantially hollow, elongate body having a front portion, a pair of side portions, a back portion, a closed bottom end, and an open upper end;

(b) a plurality of general dividers located in said upper end and defining a plurality of general apertures for receiving a plurality of golf clubs;

(c) a protective divider located in said upper end, said protective divider connected to and extending rearward from said front portion of said body to define:

(i) a first protective aperture for receiving a putter, said first protective aperture located in the area adjacent a center of said front portion, and (ii) a second protective aperture for receiving a second golf club, said second protective aperture located in the area rearward of said first protective aperture and generally aligned with a centerline extending between the center of said front portion of said body and a center of said back portion, whereby the putter and second golf club are located generally along said centerline and are segregated from the plurality of golf clubs received in said general apertures, wherein a distance from an upper surface of said closed bottom end to an edge of said upper end adjacent to said first protective aperture is such that a head of the putter is located above said edge of said upper end adjacent to said first protective aperture when a grip of the putter contacts said upper surface of said closed bottom end, and said edge of said upper end adjacent to said first protective aperture forms an indentation, said indentation having an edge with a height lower than other portions of said upper end, said head of said putter extending above said indentation.

18. The golf bag of claim 17, wherein said protective divider is generally U-shaped.

19. The golf bag of claim 17, wherein said protective divider has a height that extends above a head of the putter received in said first protective aperture, thereby protecting the head of the putter.

20. The golf bag of claim 17, wherein a partition extends between said protective divider and said closed bottom end.

21. The golf bag of claim 17, wherein the height of said indentation relative to said an upper surface of said closed bottom end is approximately 32 inches and the height of an upper edge of said protective divider in the region of said first protective aperture relative to an upper surface of said closed bottom end is approximately 36.5 inches.

22. A golf bag for receiving and transporting golf clubs, said golf bag comprising:

a substantially hollow, elongate body having a front portion, a pair of side portions, a back portion, an open upper end, and a lower end, said upper end defining a first edge that slopes downwardly along said side portions and from said back portion to said front portion; and an upper element attached to said upper end of said body, said upper element including a divider that is generally located in a central portion of said upper end, said divider defining a second edge that slopes upwardly in a direction from said back portion to said front portion, wherein said divider is generally U-shaped and has a pair of spaced leg segments and a base segment, each said leg segment having a terminal end and an opposite end that is connected to said base segment, said upper end of said body including an indentation located between said leg segments, said indentation having an edge with a height lower than other portions of said upper end.

23. The golf bag of claim 22, wherein said divider defines at least one aperture located between said leg segments.

24. The golf bag of claim 22, wherein said upper element includes a plurality of additional dividers extending from said divider to said first edge to form a plurality of apertures located adjacent to said first edge.

25. A golf bag for receiving and transporting golf clubs, said golf bag comprising:

a substantially hollow, elongate body having a front portion, a pair of side portions, a back portion, an open upper end, and a lower end, said upper end defining a first edge that slopes downwardly along said side portions and from said back portion to said front portion; and an upper element attached to said upper end of said body, said upper element including a generally U-shaped divider having:

a base segment, and a pair of spaced leg segments with a terminal end and an opposite end, said terminal end extending over said first edge and beyond an outer surface of said front portion of said body, and said opposite end being connected to said base segment wherein said U-shaped divider defines a second edge that slopes upwardly in a direction from said back portion to said front portion, wherein said upper end of said body includes an indentation located between said leg segments, said indentation having an edge with a height lower than other portions of said upper end.

26. The golf bag of claim 25, wherein said upper element includes a plurality of additional dividers extending from said U-shaped divider to said first edge to form a plurality of apertures located adjacent to said first edge.

* * * * *